US009774119B2

(12) United States Patent
Yamane et al.

(10) Patent No.: US 9,774,119 B2
(45) Date of Patent: Sep. 26, 2017

(54) CONNECTOR

(71) Applicant: Molex, LLC, Lisle, IL (US)

(72) Inventors: Tetsuya Yamane, Yamato (JP); Akihiko Okajima, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/335,157

(22) Filed: Oct. 26, 2016

(65) Prior Publication Data

US 2017/0141500 A1 May 18, 2017

(30) Foreign Application Priority Data

Nov. 18, 2015 (JP) ..... 2015-225954

(51) Int. Cl.
*H01R 12/79* (2011.01)
*H01R 12/70* (2011.01)

(52) U.S. Cl.
CPC ..... *H01R 12/79* (2013.01); *H01R 12/7058* (2013.01)

(58) Field of Classification Search
CPC ..... H01R 23/722; H01R 12/79; H01R 23/684
USPC ..... 439/329, 260
See application file for complete search history.

(56) References Cited

U.S. PATENT DOCUMENTS 3,475,717 A * 10/1969 Lane ..... H01R 12/89 439/260
3,897,991 A * 8/1975 Pritulsky ..... H01R 12/89 439/260
4,379,608 A * 4/1983 Olsson ..... H01R 12/62 439/329
4,636,021 A * 1/1987 Bobb ..... H01R 12/89 439/260
4,679,879 A * 7/1987 Triner ..... H01R 12/79 439/425
7,025,617 B2 * 4/2006 Regnier ..... H01R 13/6474 439/329
7,845,962 B2 * 12/2010 Chung ..... H01R 12/79 439/260
2014/0057475 A1 * 2/2014 Tohjo ..... H01R 12/88 439/329

FOREIGN PATENT DOCUMENTS

JP 2005-078908 A 3/2005

* cited by examiner

*Primary Examiner* — Gary Paumen
(74) *Attorney, Agent, or Firm* — James A. O'Malley

(57) ABSTRACT

The connector has a housing and a retainer. The retainer is accommodated in the housing and has a base portion and a front upper beam extending forward from the base portion and positioned above an insertion passage of a flat cable. The upper beam includes a middle portion positioned in the middle of the upper beam and a forward extending portion extending forward from the middle portion. The middle portion has an engaging portion configured to engage an engaged portion of the cable, and at least a portion is positioned in the passage of the cable. A region is provided in the leading end of the extending portion above the leading end of the extending portion for restricting upward movement. The upper beam is elastically deformable so that the middle portion moves upward when the upward movement of the leading end of the extending portion is restricted by the region.

8 Claims, 8 Drawing Sheets

CONNECTOR

RELATED APPLICATIONS

This application claims priority to Japanese Application No. 2015-225954, filed Nov. 18, 2015, which is incorporated herein by reference in its entirety.

TECHNICAL FIELD

The present disclosure relates to a connector for connecting a flat cable to a circuit board.

BACKGROUND ART

Some connectors are mounted on a circuit board and then used to establish an electrical connection between a flat cable and the circuit board. These connectors are configured to receive an inserted end portion of the flat cable. These connectors have a retainer to keep the flat cable from becoming detached. In Patent Document 1, a notch is formed in both the left and the right edges of a flat cable (FPC 10 in Patent Document 1), and the retainer (contact 7) has a front upper beam (contact portion 75) extending forward from the base portion (hinge portion 74) and a rear upper beam (lever portion 76) extending rearward from the base portion. An engaging portion (lock portion 75a) is formed in the leading end of the front upper beam to engage the notches in the flat cable. The cam portion of an actuator (contact force applying member 9) is arranged on the lower side of the rear upper beam. After a flat cable has been inserted into the connector, the actuator is tilted to the rear. Then, the rear upper beam is pushed upward by the cam portion of the actuator and the front upper beam is tilted downward. As a result, the engaging portion (lock portion 75a) of the front upper beam engages the notches in the flat cable. This keeps the flat cable and the connector from becoming detached.

Patent Document 1: Laid-Open Patent Publication No. 2005-78908

SUMMARY

The prior art connector disclosed in Patent Document 1 is configured so that the engaging portion of the retainer does not make contact with the flat cable while the flat cable is being inserted into the connector, and insertion force is not required when the flat cable is inserted. Therefore, it can be difficult for the operator to sense when the flat cable has been inserted completely.

The present disclosure proposes a connector having one means of enabling an operator to sense when a flat cable has been inserted completely.

The present disclosure is a connector comprising a housing having an opening on the front end and an insertion passage for a flat cable connected to the rear of the opening, a plurality of terminals accommodated in the housing and configured so as to electrically connect the flat cable, and a retainer accommodated in the housing and having a base portion and a front upper beam extending forward from the base portion and positioned above the insertion passage, the front upper beam including a middle portion positioned in the middle of the front upper beam and having an engaging portion configured so as to engage an engaged portion formed in the flat cable and a forward extending portion extending forward from the middle portion, at least a portion of the engaging portion being positioned in the insertion passage, a region being provided in the leading end of the forward extending portion above the leading end of the forward extending portion for restricting upward movement of the leading end of the forward extending portion, and the front upper beam being elastically deformable so that the middle portion moves upward when the upward movement of the leading end of the forward extending portion is restricted by the region. In this way, an operator can sense when a flat cable has been inserted completely.

In another aspect of the connector, the retainer has a rear upper beam extending to the rear from the base portion, the connector further comprises an actuator having a cam portion positioned below the rear upper beam of the retainer, and the rear upper beam of the retainer is pushed upward by the cam portion and the front upper beam of the retainer moves downward when the actuator is rotated.

In another aspect of the connector, the rear upper beam of the retainer is pushed upward by the cam portion, the front upper beam of the retainer tilts downward, and the leading end of the forward extending portion of the retainer is positioned above the insertion passage of the flat cable when the actuator is rotated without a flat cable having been inserted.

In another aspect of the connector, the retainer has a lower beam extending from the base portion, and the lower beam has a connecting portion positioned in front of the front edge of the housing and mounted on a circuit board or has a connector portion positioned to the rear of the rear edge of the housing and mounted on a circuit board.

In another aspect of the connector, the front extended portion has an upper surface extending upward and forward, and the leading end of the upper surface of the forward extending portion is positioned in the region when the middle portion has moved upward.

In another aspect of the connector, the region restricting upward movement of the leading end of the forward extending portion is the inner surface of the housing.

In another aspect of the connector, the base portion of the retainer has a lance fixed to the inner surface of the housing in the upper end.

In another aspect of the connector, each of the plurality of terminals includes a base portion, a front upper beam having a contact portion extending forward from the base portion and making contact with the surface of the flat cable, and a rear upper beam extending to the rear from the base portion and positioned above the cam portion, the rear upper beam of the terminal being pushed upward by the cam portion and the front upper beam of the terminal tilting downward when the actuator is rotated.

DETAILED DESCRIPTION OF THE PREFERRED EMBODIMENTS

Figure 1:
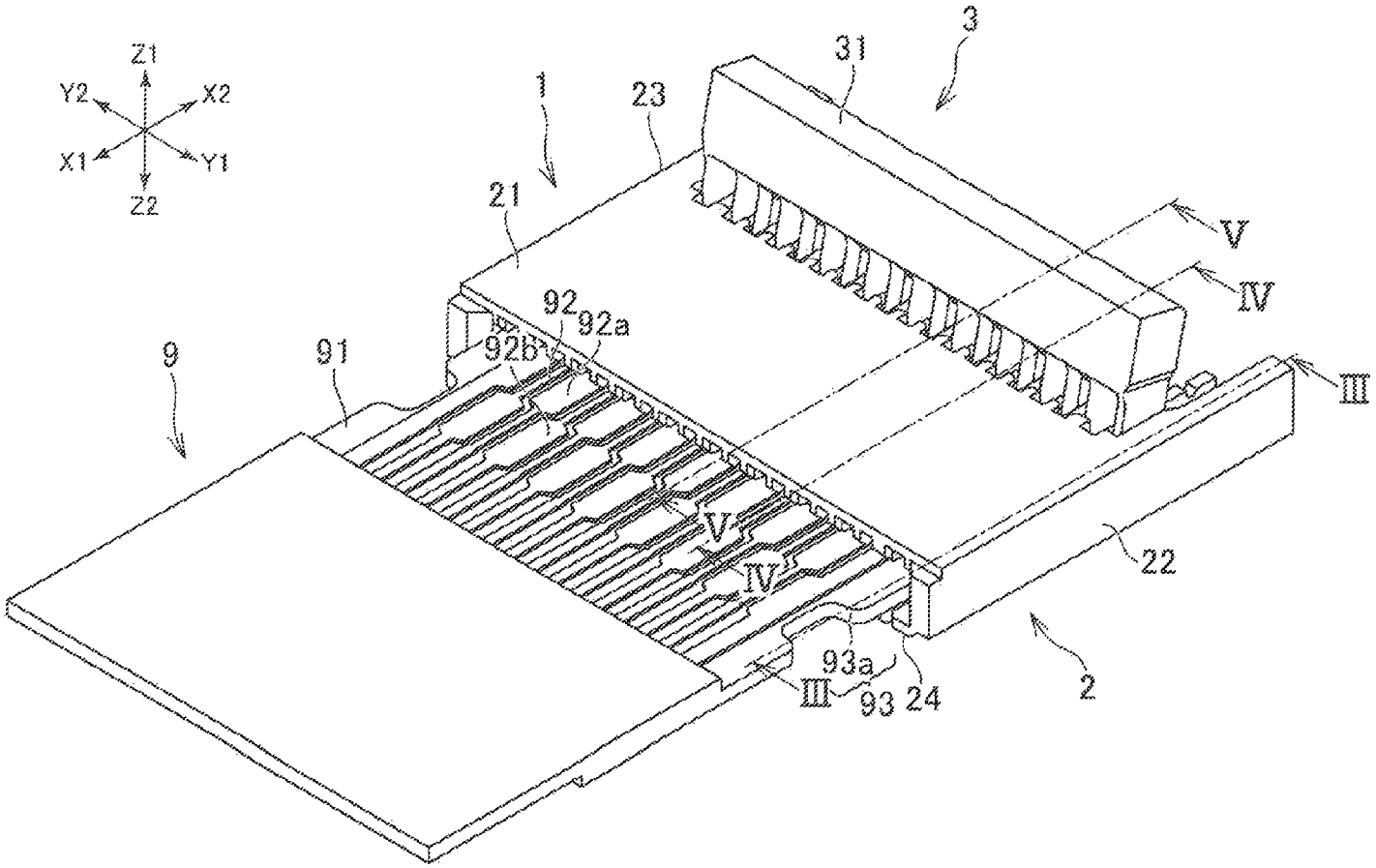
FIG. 1 is a perspective view showing the connector 1 and the flat cable 9 in an embodiment of the present disclosure.
Figure 2:
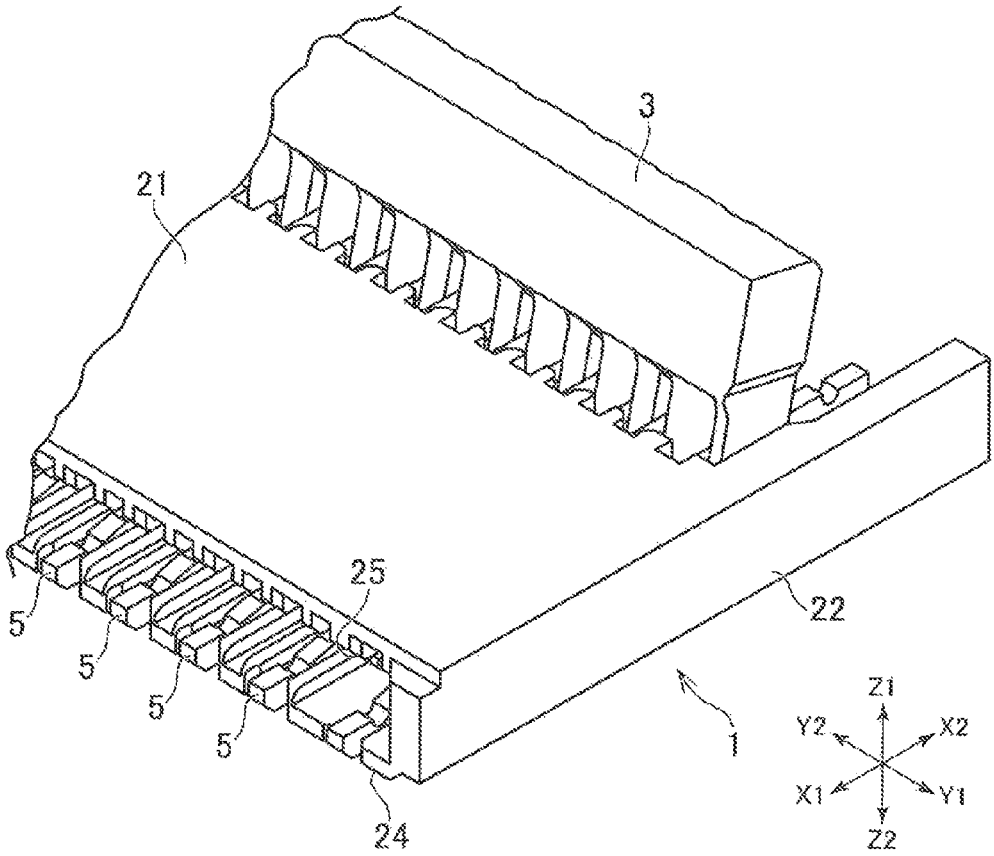
FIG. 2 is an enlarged view of the connector 1.
Figure 3:
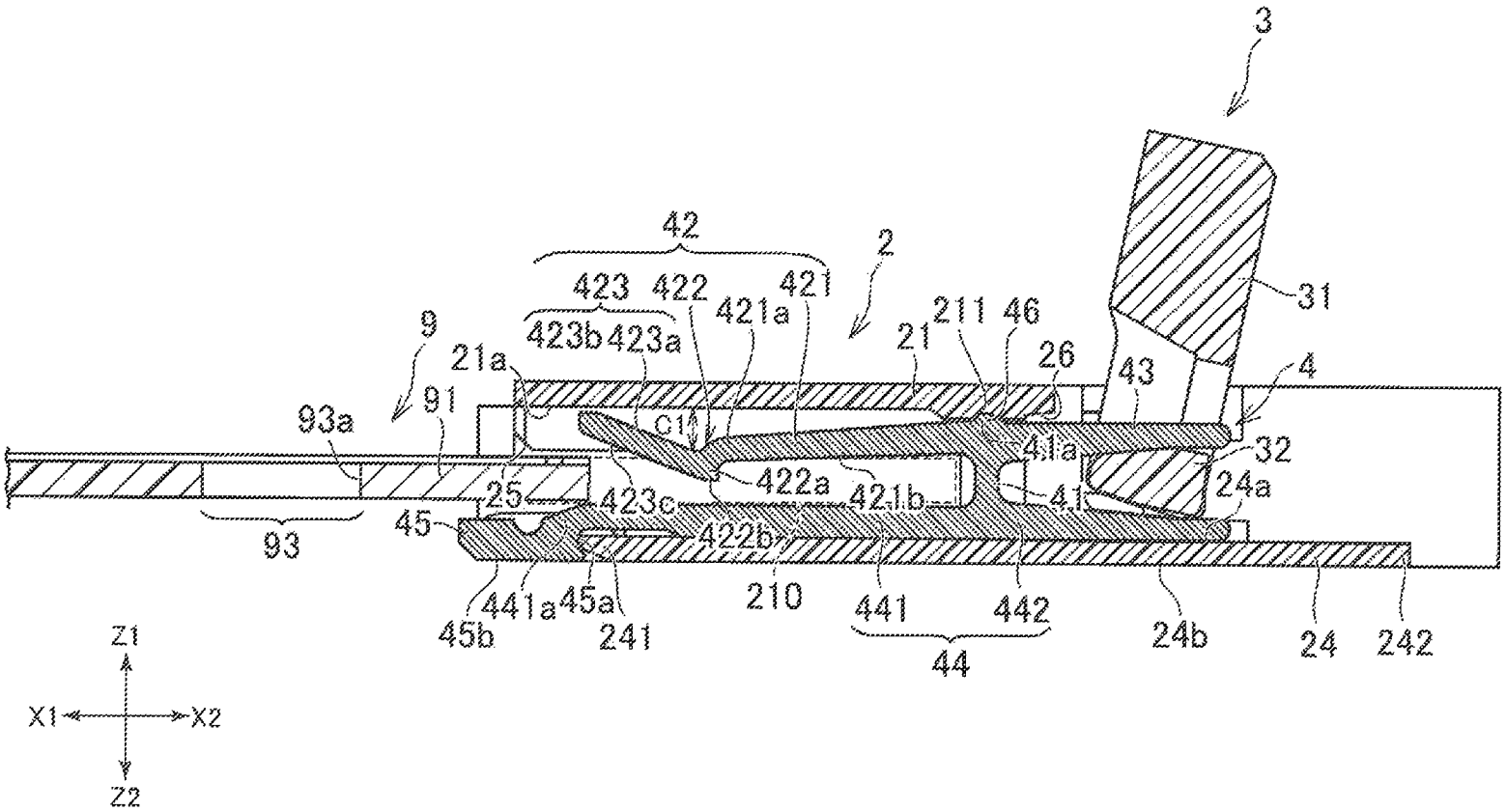
FIG. 3 is a cross-sectional view of the retainer 4 from line III-III in FIG. 1.
Figure 4:
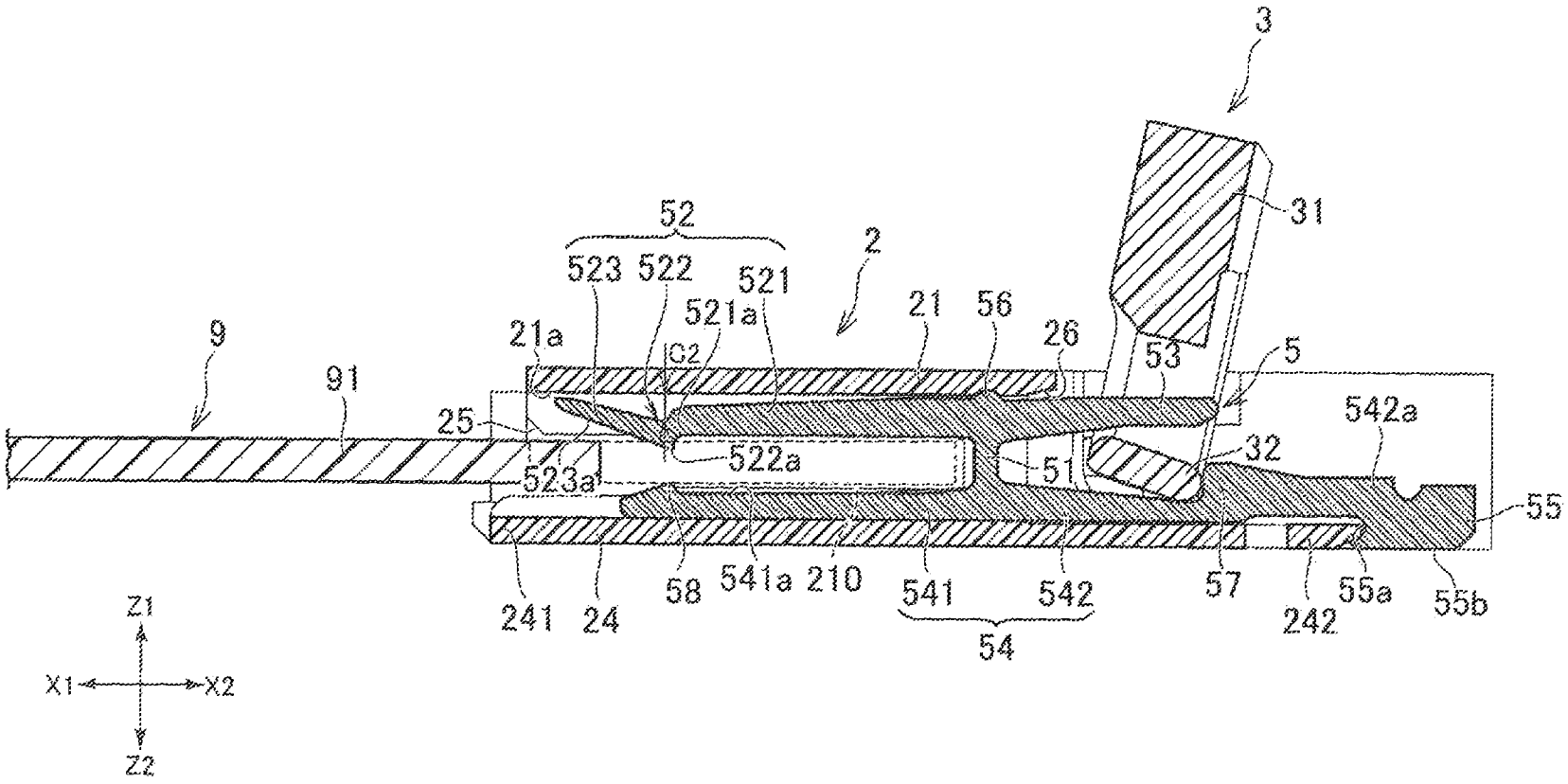
FIG. 4 is a cross-sectional view of a first terminal 5 from line IV-IV in FIG. 1.
Figure 5:
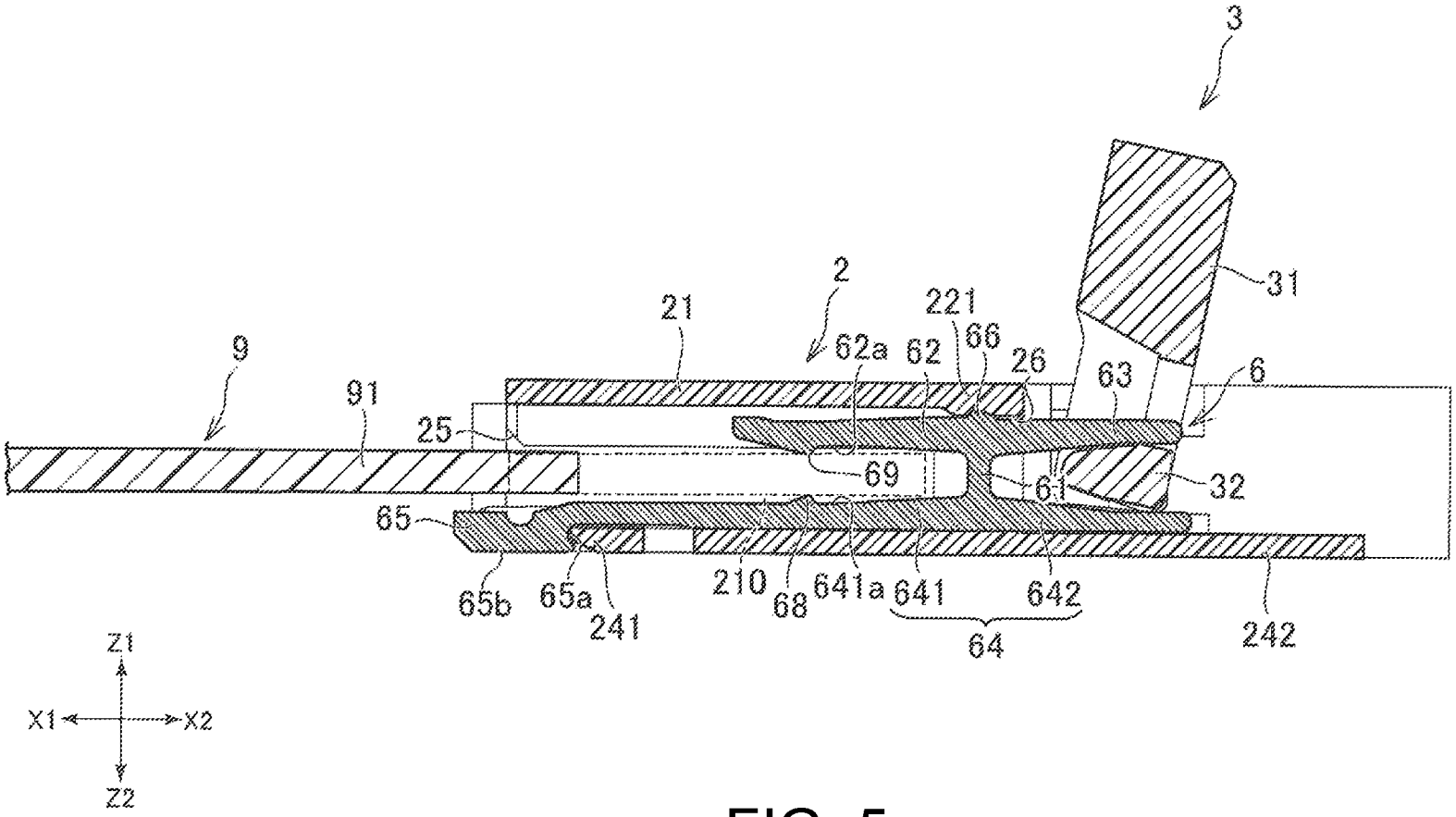
FIG. 5 is a cross-sectional view of a second terminal 6 from line V-V in FIG. 1.
Figure 6A:
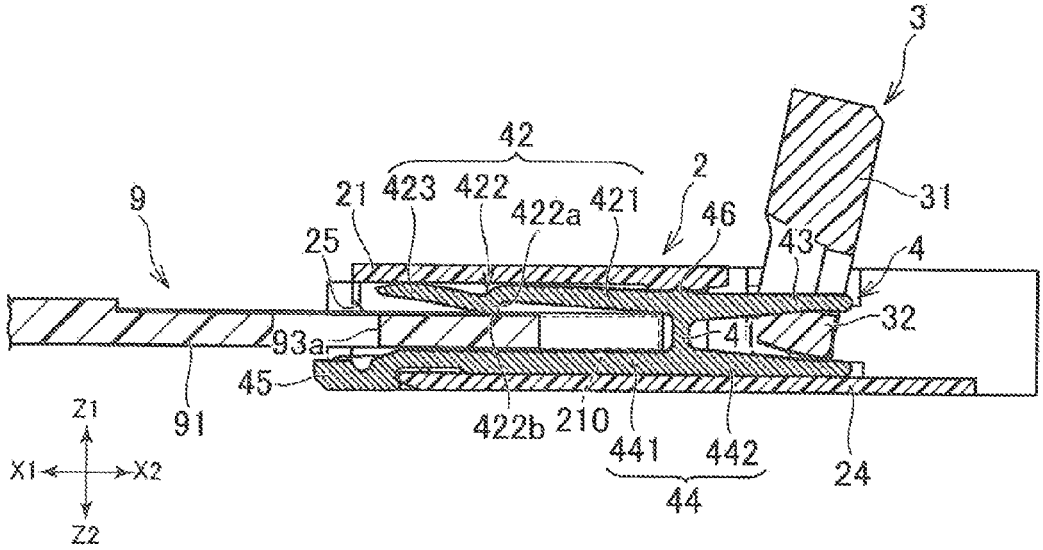
FIG. 6A is the cross-sectional view in FIG. 3 showing the flat cable 9 being inserted.
Figure 6B:
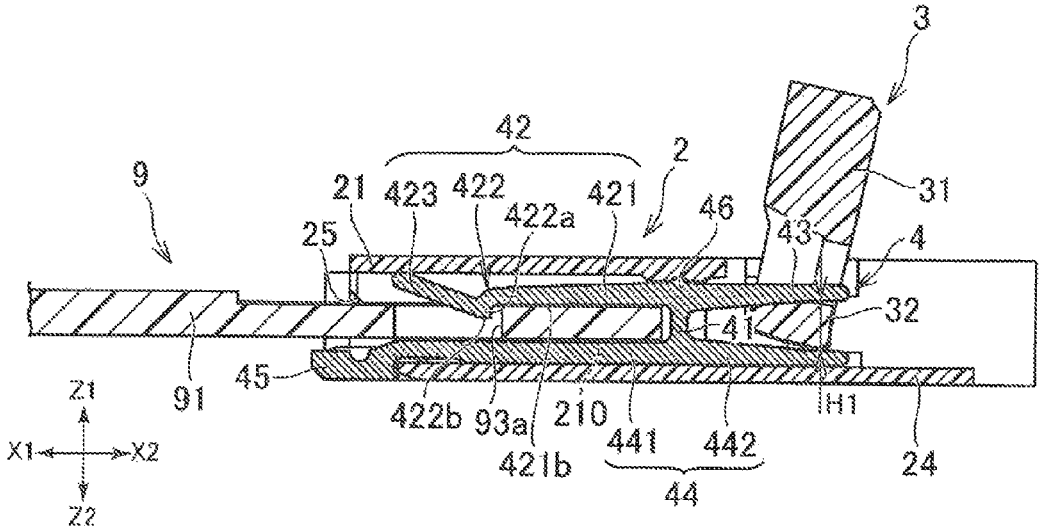
FIG. 6B is the cross-sectional view in FIG. 3 showing the flat cable 9 after insertion.
Figure 6C:
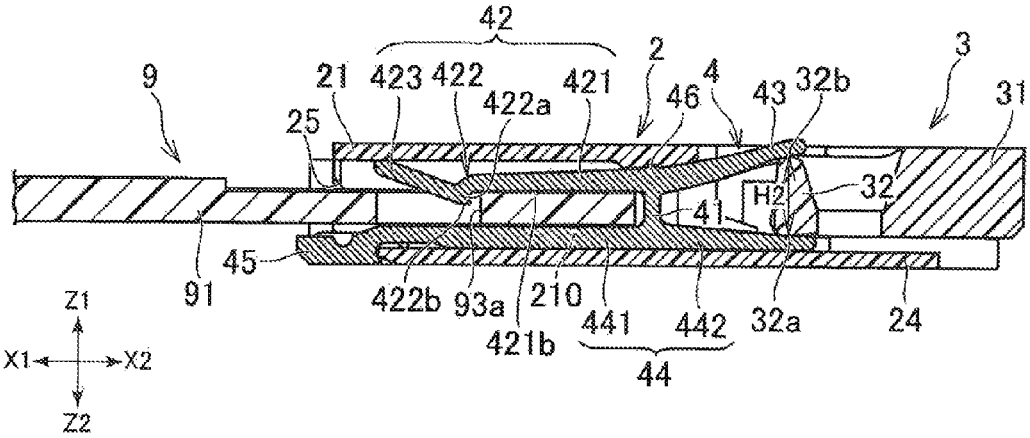
FIG. 6C is the cross-sectional view in FIG. 6B showing the second orientation of the actuator 3.
Figure 7A:
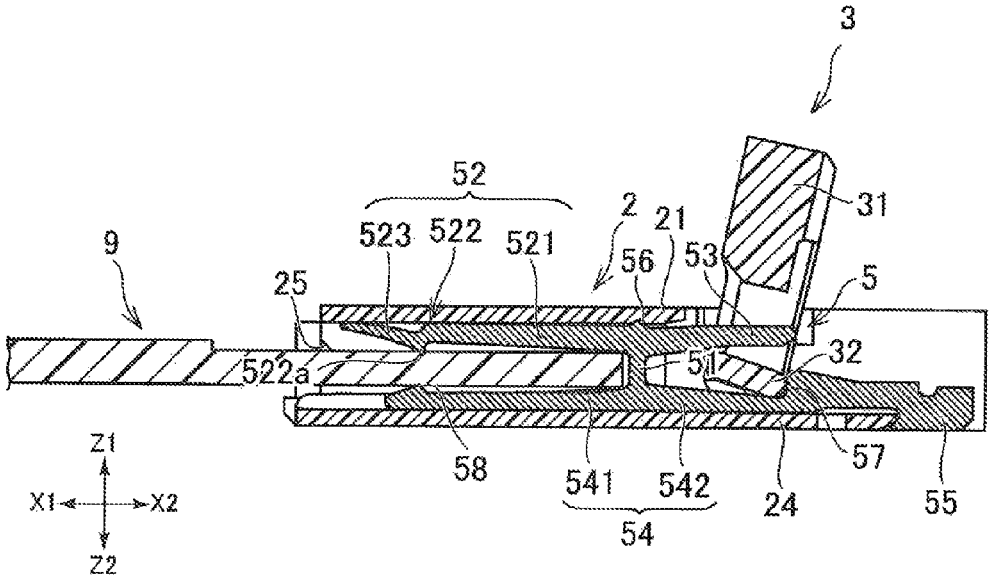
FIG. 7A is the cross-sectional view in FIG. 4 showing the flat cable 9 after insertion.
Figure 7B:
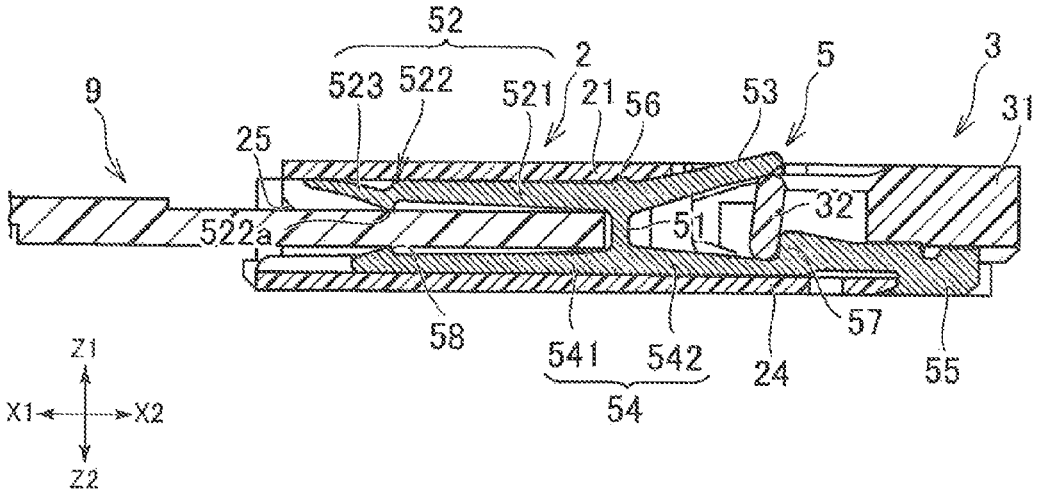
FIG. 7B is the cross-sectional view in FIG. 7A showing the second orientation of the actuator 3.

The following is an explanation of the connector 1 in the present embodiment with reference to FIG. 1 through FIG. 7B. FIG. 1 is a perspective view showing the connector 1 and the flat cable 9 in an embodiment of the present disclosure. FIG. 2 is an enlarged view of the connector 1. FIG. 3 is a cross-sectional view of the retainer 4 from line III-III in FIG. 1. FIG. 4 is a cross-sectional view of a first terminal 5 from line IV-IV in FIG. 1. FIG. 5 is a cross-sectional view of a second terminal 6 from line V-V in FIG. 1. FIG. 6A through FIG. 6C are the cross-sectional view from line III-III in FIG. 1 showing the relationship between the connector 1 and the flat cable 9. FIG. 7A and FIG. 7B are the cross-sectional view from line IV-IV in FIG. 1 showing the relationship between the connector 1 and the flat cable 9. In each drawing, the front side in the insertion direction of the flat cable is the X1 side and the inside direction is the X2 side. These indicate the forward direction and the rearward direction, respectively. The width directions of the connector in the directions away from the open side of the connector in each drawing are the Y1 direction and the Y2 direction. These are the leftward direction and the rightward direction, respectively. The thickness directions of the connector in each drawing are the Z1 direction and the Z2 directions. These are the upward direction and the downward direction, respectively.

The connector 1 in the present embodiment is a connector in which a flat cable 9 can be inserted from the front. As shown in FIG. 1, the connector 1 is a substantially angular cylinder, and the end portion 91 of the flat cable 9 is inserted inside. The flat cable 9 may be a flexible printed circuit (FPC) or a flexible flat cable (FFC).

As shown in FIG. 1 and FIG. 2, the connector 1 includes a retainer 4, a plurality of first terminals 5, and a housing 2 for accommodating the retainer 4 and the first terminals 5. The first terminals 5 are configured to establish an electrical connection with a flat cable 9. The first terminals 5 may be arranged in the transverse direction inside the housing 2. Also, the connector 1 may have a plurality of second terminals 6 for establishing an electrical connection with a flat cable 9. These may be arranged with the first terminals 5 in the transverse direction by alternating with each first terminal 5. The retainer 4 is parallel to the first terminals 5 (or second terminals 6) in the transverse direction. The retainer 4 is arranged in two spots, namely, between the first terminals 5 positioned on the left end and the side wall 22 positioned on the left side and between the first terminals 5 positioned on the right end and the side wall 23 positioned on the right side.

The housing 2 is substantially cylindrical, and a substantially rectangular opening 25 is formed in the front end for insertion of a flat cable 9. The housing 2 may be formed from an insulating material such as a resin. The housing 2 has an upper wall 21 constituting the upper surface of the housing 2, a side wall 22 constituting the side surface of the housing 2 on the left side, a side wall 23 constituting the side surface of the housing 2 on the right side, and a lower wall 24 constituting the lower surface of the housing 2. As shown in FIG. 3 through FIG. 5, a substantially rectangular opening 26 may also be formed on the rear side of the housing 2.

When the connector 1 is assembled, the retainer 4 and the first terminals 5 may be inserted into the housing 2 from the opening 25 on the front end, and the second terminals 6 may be inserted into the housing 2 from the opening 26 on the rear end. Both the upper wall 21 and the lower wall 24 of the housing 2 have a groove extending in the longitudinal direction for inserting each of the first terminals 5 and second terminals 6. In this way, movement of the retainer 4, the first terminals 5, and the second terminals 6 can be restricted inside the housing 2.

As shown in FIG. 1, a plurality of conductive surfaces 92 made of a conductive material such as a metal are formed on the upper surface of the end portion 91 of the flat cable 9. The plurality of conductive surfaces 92 are arranged in the end portion 91 of the flat cable 9 in the transverse direction. A plurality of conductive surfaces 92 may also be formed on the lower surface of the end portion 91. Wiring (not shown) is connected to each one of the plurality of conductive surfaces 92. The end portion 91 of the flat cable 91 may also be connected electrically to conductive surfaces formed on the other end of the cable via wiring. When the flat cable 9 has been inserted into the connector 1 (the housing 2), each conductive surface 92 may come into contact and establish an electrical connection with either a first terminal 5 or a second terminal 6. Each conductive surface 92 extends in the longitudinal direction, and may have a contacted portion 92*a*, 92*b* which widens to the left and right from a central position. As shown in FIG. 1, a contacted portion 92*a* may be arranged to the rear of a contacted portion 92*b* or in front of a contacted portion 92*b*. In this arrangement, conductive surfaces 92 having contacted portion 92*a* alternate with conductive surfaces 92 having contacted portion 92*b*. In this way, contacted portions 92*a* and contacted portions 92*b* are arranged in a zigzag pattern when viewed from above, increasing the area covered by contacted portions 92*a* and contacted portions 92*b*. In this way, the conductive surface 92 in the flat cable 9 make more stable contact with first terminals 5 and second terminals 6 of the connector 1.

An engaged portion is formed in the end portion 91 of the flat cable 9 to engage the engaging portion 422*a* (described below) formed in the retainer 4 and to prevent detachment of the flat cable 9. The end portion 91 of the flat cable 9 may have a rectangular notch 93 formed on the left end and the right end. In this case, the engaged portion of the flat cable 9 may also be provided with notches 93 which include end surfaces 93*a* extending in the transverse direction at the rear end of the notches 93. Alternatively, a ridge or hole opening in the upper surface may be formed in the end portion 91 of the flat cable 9, and the engaged portion may include an edge on the rear end of the groove or hole.

The connector 1 may have an actuator 3 including an operated portion 31 and a cam portion 32 described below. The actuator 3 may be made of an insulating material such as a resin, and be provided between the side wall 22 on the left side and the side wall 23 on the right side.

As shown in FIG. 3 through FIG. 5, an insertion passage 210 for the flat cable 9 is provided in the housing 2 which is connected to the rear of the opening 25 on the front end. The insertion passage 210 may be a rectangular space for inserting the flat cable 9, and may be provided in a portion of the interior of the housing 2 surrounded in the vertical and horizontal directions by the upper wall 21, the side wall 22 on the left side, the side wall 23 on the right side, and the lower wall 24 of the housing 2.

As shown in FIG. 3, a retainer 4 is arranged inside the housing 2. The retainer 4 has a base portion 41 extending in the vertical direction, and a front upper beam 42 extending forward from the upper side of the base portion 41 and positioned above the insertion passage 210. The retainer 4 may have a rear upper beam 43 extending to the rear from the upper side of the base portion 41, and a lower beam 44 extending in the longitudinal direction from the lower side of the base portion 41. The rear upper beam 43 may be positioned in substantially the same position as the front upper beam 42 in the vertical direction along a line extending from the front upper beam 42. The lower beam 44 may extend in rod-like manner in the longitudinal direction, and at least the portion including the middle portion may contact the upper surface 24*a* of the lower wall 24. Also, the lower beam 44 may have a front lower beam 441 extending forward from the base portion 41 and positioned below the insertion passage 210, and a rear upper beam 442 extending to the rear from a base portion 41 along a line extending from the front lower beam 441.

The front lower beam 441 of the retainer 4 may have a connecting portion 45 positioned in front of the front edge of the housing 2 (that is, front edge 241 of the lower wall 24). The connecting portion 45 may be connected to the front end 441*a* of the front lower beam 441 extending to the front edge 241 of the lower wall 24 in the longitudinal direction, and may have a wall surface 45*a* extending downward from the front end 441*a* of the front lower beam 441. The wall surface 45*a* engages the front edge 241 of the lower wall 24 to restrict rearward movement of the retainer 4 inserted into the housing 2. This prevents overinsertion of the retainer 4. Also, the connecting portion 45 may have a connecting surface 45*b* extending longitudinally along the lower surface 24*b* of the lower wall 24. The connector 1 may be arranged on top of a circuit board (not shown). At this time, the connecting surface 45*b* formed in the connecting portion 45 may be mounted on the upper surface of the circuit board using solder. The present disclosure is not limited to the example in FIG. 3, and the rear lower beam 442 of the retainer 4 may have a connecting portion positioned to the rear of the rear edge (that is, the rear edge 242 of the lower wall 24) of the housing 2. In this case, the rear lower beam 442 may extend to the rear edge 242 of the lower wall 24, and the connecting portion may be connected to the rear end of the rear lower beam 442.

As shown in FIG. 3, the cam portion 32 may be formed in the actuator 3 on the side opposite the one on which the operated portion 31 is formed. The cam portion 32 of the actuator 3 may be positioned below the rear upper beam 43 of the retainer 4 and positioned above the rear lower beam 442 of the retainer 4. The cam portion 32 of the actuator 3 may be held in the vertical direction between the rear upper beam 43 and the rear lower beam 442 of the retainer 4 to incorporate the actuator 3 into the connector 1.

The base portion 41 of the retainer 4 has a lance 46 on the upper end 41*a* which is fixed to the lower surface 21*a* of the upper wall 21 of the housing 2. Also, the upper wall 21 of the housing 2 may have a fixing portion 211 that protrudes downward. In this case, as shown in FIG. 3, the lance 46 of the retainer 4 is caught by the fixing portion 211 formed on the upper wall 21 of the housing 2 to fix the retainer 4 inside the housing 2.

The front upper beam 42 of the retainer 4 has a middle portion 421 extending forward from the base portion 41 with a thickness that narrows in the vertical direction going forward, a middle portion 422 connected to middle portion 421 and positioned in the middle of the front upper beam 42, and a front extended portion 423 extending forward from middle portion 422. Clearance C1 widening in the vertical direction may be provided above middle portion 422 to allow for upward movement of middle portion 422.

Here, middle portion 422 of the retainer 4 may have an engaging portion 422*a* configured to engage an engaged portion (for example, notches 93) formed in the flat cable 9. The engaged portion 422*a* may include a pressing portion 422*b* extending in the longitudinal direction at the lower end of the middle portion 422 and positioned in the insertion passage 210. In other words, at least one portion of the engaging portion 422*a* may be positioned in the insertion passage 210. In this case, as shown in FIG. 6B and FIG. 6C, when the engaging portion 422*a* is engaging the engaged portion of the flat cable 9, at least one portion of the engaging portion 422*a* including the pressing portion 422*b* may be inserted into the engaged portion (that is, inside the notches 93). The engaging portion 422*a* may include a wall surface extending downward from the front end 421*a* of the middle portion 421 and facing rearward. At this time, the wall surface formed in the engaging portion 422*a* may catch the end surface 93*a* in the rear end of the notches 93 of the flat cable 9.

The front extended portion 423 of the retainer 4 may have an upper surface extending forward and above at an angle from middle portion 422. The upper surface of the middle portion 422 may have a first surface 423*a* extending at a bent or curved angle, and a second surface 423*b* extending forward from the front end and constituting the leading end of the front extended portion 423. The front extended portion 423 may have a lower surface 423*c* extending upward at an angle from the pressing portion 422*b* formed on the lower end of the middle portion 422. The lower surface 423*c* may extend upward from inside the insertion passage 210. When the retainer 4 has a lower surface 423*c* with this configuration, the leading end of the flat cable 9 strikes the lower surface 423*c* and the leading end of the flat cable 9 moves into the insertion passage 210. In other words, insertion of the flat cable 9 can be guided.

As shown in FIG. 4, first terminals 5 are arranged inside the housing 2. Similar to the retainer 4, each first terminal 5 has a base portion 51 extending in the vertical direction, a front upper beam 52 extending forward from the upper side of the base portion 51 and positioned above the insertion passage 210, a rear upper beam 53 extending rearward from the upper side of the base portion 51, a lower beam 54 extending rod-like in the longitudinal direction from the lower side of the base portion 51, and a lance 56 extending upward from the base portion 51 and fixed to the lower surface 21*a* of the upper wall 21 of the housing 2. At least one portion of the middle portion of the lower beam 54 may come into contact with the upper surface 24*a* of the lower wall 24. The lower beam 54 may also have a front lower beam 541 extending forward from the base portion 51 and positioned below the insertion passage 210, and a rear lower beam 542 extending to the rear from the base portion 51 on a line extended from the front lower beam 541.

A connecting portion 55 may be formed in the rear end 542*a* of the rear lower beam 542 of each first terminal 5 which is positioned to the rear of the rear edge of the housing 2 (that is, the rear edge 242 of the lower wall 24). The connecting portion 55 may have a wall surface 55*a* extending downward from the rear end 542*a* of the rear lower beam 542 and engaging the rear edge 242 of the lower wall 24 to regulate the forward movement of the first terminal 5. Also, the connecting portion 55 may have a connecting surface 55*b* extending in the longitudinal direction along the lower surface 24*b* of the lower wall 24 and connected to a circuit board (not shown). By fixing the connecting surface 55*b* to a conductive surface made of a conductive material such as metal in the circuit board, an electrical connection is established between the first terminal 5 and the circuit board. Similar to the retainer 4, the lower beam 54 of the first terminal 5 may have a connecting portion positioned in front of the front edge of the housing 2 (that is, the front edge 241 of the lower wall 24) and connected to the front end of the front lower beam 541.

The cam portion 32 of the actuator 3 may be positioned below the rear upper beam 53 of the first terminal 5 and above the rear lower beam 542 of the first terminal 5. Here, a rear support portion 57 may be formed in the rear lower beam 542 which extends upward from the lower surface of the rear lower beam 542 and presses against the rear side of the cam portion 32. The actuator 3 may be supported by the upper surface of the rear lower beam 542 as well as the lower surface and the upper surface of the cam portion 32 by the rear support portion 57. Also, the cam portion 32 may be separated downward from the rear upper beam 53 when the actuator 3 has an open position (see FIG. 3 and FIG. 4).

Similar to the retainer 4, the front upper beam 52 of each first terminal 5 may have a middle portion 521 extending forward from the base portion 51 and having a height that gets smaller in the vertical direction moving forward, a middle portion 522 connected to middle portion 521 and positioned in the middle of the rear upper beam 52, and a front extended portion 523 extending forward and upward at an angle from the middle portion 522. Clearance C2 widening in the vertical direction may be provided above middle portion 522 to allow for upward movement of middle portion 522. Also, a lower surface 523*a* may be formed in the front extended portion 523 of the first terminal 5 which extends upward from inside the insertion passage 210, and guides the leading end of the flat cable 9 into the insertion passage 210.

Here, the middle portion 522 of the first terminal 5 may have a contact portion 522*a* making contact with the surface of the flat cable 9. The contact portion 522*a* may protrude downward from the middle portion 522 and be positioned in the insertion passage 210. The contact portion 522*a* of the first terminal 5 may come into contact with a conductive surface 92 arranged on the upper surface of the end portion 91 of the flat cable 9. Also, as shown in FIG. 4, when the contact portion 522*a* of the first terminal 5 is formed in front of the contact portion 69 of a second terminal 6 (see FIG. 5), the contact portion 522*a* may come into contact with a contacted portion 92*b* formed in front of the contacted potion 92*a* of the conductive surface 92 (see FIG. 1). Also, the front lower beam 541 of a first terminal 5 may have a contact portion 58 formed to make contact with the surface (lower surface) of the flat cable 9. The contact portion 58 is formed to protrude upward from the upper surface 541*a* of the front lower beam 541 and may be positioned in the insertion passage 210.

As shown in FIG. 5, second terminals 6 may be arranged inside the housing 2. As in the case of the first terminals 5, each second terminal 6 may have a base portion 61 extending in the vertical direction, a front upper beam 62 extending forward from the upper side of the base portion 61 and positioned above the insertion passage 210, a rear upper beam 63 extending rearward from the upper side of the base portion 61 and arranged above the cam portion 32 of the actuator 3, a lower beam 64 extending rod-like in the longitudinal direction from the lower side of the base portion 61, and a lance 66 extending upward from the base portion 61 and fixed to inner surface of the housing 2 (for example, the fixing portion 211 protruding downward from the upper wall 21). At least one portion of the middle portion of the lower beam 64 may come into contact with the upper surface 24*a* of the lower wall 24. The lower beam 64 may also have a front lower beam 641 extending forward from the base portion 61 and positioned below the insertion passage 210, and a rear lower beam 642 extending to the rear from the base portion 61 on a line extended from the front lower beam 641 and positioned below the cam portion 32 of the actuator 3. Similar to the retainer 4, the lower beam 64 of the second terminal 6 may have a connecting portion 65 positioned in front of the front edge of the housing 2 and connected to the circuit board (not shown). The connecting portion 65 may have a wall portion 65*a* engaging the front edge 241 of the lower wall 24 to restrict rearward movement of the second terminal 6, and a connecting surface 65*b* extending in the longitudinal direction along the lower surface 24*b* of the lower wall 24.

The front upper beam 62 of the second terminals 6 may extend rod-like in the longitudinal direction. The front upper beam 62 may also have a contact portion 69 protruding downward from the lower surface 62*a* of the front upper beam 62 and making contact with the surface of the flat cable 9 while positioned in the insertion passage 210. The contact portion 69 of the second terminal 6 may make contact with a conductive surface 92 arranged on the upper surface of the end portion 9 of the flat cable 9. As shown in FIG. 5, when the contact portion 69 of a second terminal 6 is formed to the rear of the contact portion 522*a* of a first terminal 5 (see FIG. 5), the contact portion 69 may make contact with the contacted portion 92*a* formed to the rear of the contacted portion 92*b* on a conductive surface 92 (see FIG. 1). A contact portion 68 may also be formed in the front lower beam 641 of a second terminal 6 to make contact with the surface (lower surface) of a flat cable 9. When a contact portion 68 is formed so as to protrude upward from the upper surface 641*a* of the front lower beam 641, it may be positioned in the insertion passage 210.

As explained earlier, the retainer 4, the first terminals 5, and the second terminals 6 may be arranged in the transverse direction inside the housing 2, and may be arranged in substantially the same positions in the vertical direction inside the housing 2. Here, the base portion 41 of the retainer 4, the base portion 51 of the first terminals 5, and the base portion 61 of the second terminals 6 may be arranged in substantially the same position in the longitudinal direction inside the housing 2. The height of the retainer 4, the height of the first terminals 5, and the height of the second terminals 6 may also be substantially aligned in the vertical direction. The front upper beam 62 of the second terminals 6 may have substantially the same shape as the front upper beam 52 of the first terminals 5, and may be elastically deformable in the same manner as the front upper beam 52.

The following is an explanation of the operations performed by the retainer 4 when a flat cable 9 is inserted with reference to FIG. 3 and to FIG. 6A through FIG. 6C.

As shown in FIG. 3, at least a portion of the engaging portion 422*a* formed in the front upper beam 42 of the retainer 4 may be positioned inside the insertion passage 210. In other words, the pressing portion 422*b* formed in the lower end of the middle portion 422 may be positioned below an imaginary plane constituting the upper surface of the insertion passage 210. In this way, the leading end of the flat cable 9 strikes the middle portion 422 of the retainer 4 when the flat cable 9 is inserted, which moves the middle portion 422 upward (see FIG. 6A). Here, a region may be provided in the leading end of the front extended portion 423 above the leading end of the front extended portion 423 to restrict the upward movement of the leading end of the front extended portion 423. The region restricting this movement may be the lower surface 21*a* of the upper wall 21 constituting the inner surface of the housing 2. In other words, when the middle portion 422 moves upwards, the leading end of the upper surface of the front extended portion 423 (for example, the second surface 423*b*) may strike the inner surface of the housing 2. Note that the portion struck by the front extended portion 423 is not limited to the inner surface of the housing 2. For example, it may be a shield provided inside the housing 2 above the insertion passage 210.

As shown in FIG. 6A, because clearance C1 is provided, the front upper beam 42 of the retainer 4 is elastically deformable so that the middle portion 422 rises while narrowing the clearance C1 even when upward movement of the leading end of the front extended portion 423 is restricted (for example, when the upper surface of the front extended portion 423 strikes the upper wall 21 of the housing 2). In this way, the engaging portion 422*a* engaging the flat cable 9 formed in the middle portion 422 can also move upward. This allows the flat cable 9 to be inserted even when upward movement of the leading end of the front extended portion 423 is restricted. Also, when the leading end of the front extended portion 423 strikes the inner surface of the housing 2, force from the front extended portion 423 and the middle portion 421 generate elastic force that pushes the middle portion 422 of the retainer 4 upwards. This enables the pressing portion 422*b* of the middle portion 422 to press against the upper surface of the end portion 91 of the flat cable 9. Note that when the front upper beam 42 is elastically deformed, the leading end of the front extended portion 423 of the front upper beam 42 may be positioned in front of the position of the leading end when the front upper beam 42 is not elastically deformed (see FIG. 3, FIG. 6B, and FIG. 6C).

As shown in FIG. 6B, when the leading end 91 of the flat cable 9 is inserted to the rear of the position shown in FIG. 6A, at least a portion of the engaging portion 422*a* formed in the retainer 4 enters into the engaged portion of the flat cable 9 (for example, inside the notches 93). Here, the wall surface facing the rear in the engaging portion 422*a* may catch the end surface 93*a* of the rear end of the notches 93. When the leading end of the front extended portion 423 of the retainer 4 strikes the inner surface of the housing 2 and upward movement is restricted, force from the front extended portion 423 and the middle portion 421 generate elastic force which pushes the middle portion 422 of the retainer 4 downward. As a result, the lower surface 421*b* of the middle portion 421 strikes the upper surface of the end portion 91 of the flat cable 9. The sound and vibrations generated by this action notify the operator that the flat cable 9 has been completely inserted into the position where the connector 1 is engaged. More specifically, the pressing portion 422*b* of the middle portion 422 presses against the upper surface of the end portion 91 of the flat cable 9 in FIG. 6A, the pressing portion 422*b* enters into the notches 93 of the flat cable 9 in FIG. 6B, and the bottom surface 421*b* of the middle portion 421 strikes the upper surface of the end portion 91 of the flat cable 9. The noise and vibration is reliably sensed by the operator, who then realizes that the flat cable 9 has become engaged with the retainer 4.

The actuator 3 can rotate between an open position in which the operated portion 31 is lifted up (see FIG. 6B) and a closed position in the operated portion 31 has been pushed down (see FIG. 6C). Here, the height (H2) from the lower end 32*a* to the upper end 32*b* of the cam portion 32 when the actuator 3 is in the closed position (see FIG. 6C) may be greater than the height (H1) from the rear lower beam 442 to the rear upper beam 43 of the retainer 4 when the actuator 3 is in the open position (see FIG. 6B). In this way, when the actuator 3 is rotated to the closed position, the rear upper beam 43 of the retainer 4 is pushed up by the cam portion 32 of the actuator 3.

When the rear upper beam 43 is pushed upward in this manner, the front upper beam 42 tilts downward with the upper side of the base portion 41 acting as the fulcrum. Because the end portion 91 of the flat cable 9 is pushed down by the lower surface 421*b* of the middle portion 421, the contact pressure with the flat cable 9 is increased, and the flat cable 9 can be secured more firmly.

When the actuator 3 is rotated to the closed position without a flat cable 9 having been inserted, just as when the actuator 3 is rotated to the closed position with a flat cable 9 having been inserted (FIG. 3C), the rear upper beam 43 of the retainer 4 may be pushed upwards by the cam portion 32 of the actuator 3, and the front upper beam 42 of the retainer 4 tilted downward. In both cases, the leading end of the front extended portion 423 of the retainer 4 (for example, the second surface 423*b*) may be positioned above the insertion passage 210 of the flat cable 9. In this way, the leading end of the front upper beam 42 of the retainer 4 can be kept from entering into the insertion passage 210, and the leading end of the front upper beam 42 and the leading end of the flat cable 9 inserted into the insertion passage 210 can be kept from colliding.

The following is an explanation of the operations performed by the first terminals 5 when a flat cable 9 is inserted with reference to FIG. 4, FIG. 7A, and FIG. 7B.

As shown in FIG. 4, the contact portion 522*a* formed in the front upper beam 52 of a first terminal 5 may be positioned inside the insertion passage 210 for inserting a flat cable 9 (for example, the lower side of an imaginary plane constituting the upper surface of the insertion passage 210). In this way, the upper surface of the flat cable 9 inserted into the insertion passage 210 (for example, the contacted portion 92*b* formed in the conductive surface 92) contacts the contact portion 522*a* and an electrical connection is established between the flat cable 9 and the first terminal 5.

As shown in FIG. 7A, the contact portion 552*a* strikes the upper surface of the flat cable 9, and the middle portion 522 is moved upwards. Here, the region at the leading end of the front extended portion 523 above the leading end of the front extended portion 523 that restricts upward movement of the leading end of the extended front portion 523 can be the lower surface 21*a* of the upper wall 21 constituting the inner surface of the housing 2 or a shield arranged inside the housing 2 above the insertion passage 210.

Similar to the retainer 4, because clearance C2 is provided, the front upper beam 52 of the first terminal 5 is elastically deformable so that the middle portion 522 rises while narrowing the clearance C2 even when upward movement of the leading end of the front extended portion 523 is restricted. In this way, the contact portion 522*a* formed in the middle portion 522 can also move upward. In other words, this allows the flat cable 9 to be inserted even when upward movement of the leading end of the front extended portion 523 is restricted. Note that when the front upper beam 52 is elastically deformed, the leading end of the front extended portion 423 of the front upper beam 52 may be positioned in front of the position of the leading end when the front upper beam 52 is not elastically deformed (see FIG. 4).

Also, as shown in FIG. 7A, when the actuator 3 is in the open position and a flat cable 9 has been inserted, the cam portion 32 may move downward away from the rear upper beam 53. When the front upper beam 52 has been pushed upwards by the leading end of the flat cable 9 while the flat cable 9 is being inserted, the rear upper beam 53 can move downward with the base portion 51 serving as the fulcrum. This can reduce the resistance against the front upper beam 52 and can reduce the insertion resistance against the flat cable 9.

As shown in FIG. 4, the height in the vertical direction of the contact portion 522*a* formed in the first terminal 5 may be greater than the lower end of the middle portion 422 of the retainer 4 (that is, the pressing portion 422*b* of the middle portion 422). In this way, excess contact can be avoided between the contact portion 522*a* of the first terminal 5 and the flat cable 9, deformation and damage to first terminal 5 can be prevented, and insertion resistance of the flat cable 9 can be reduced.

As shown in FIG. 7B, when the actuator 3 is rotated to the closed position, the rear upper beam 53 of the first terminal 5 is pushed up by the cam portion 32 of the actuator 3. Because of the downward moment acting on the front upper beam 52 with the upper side of the base portion 51 serving as the fulcrum, the force of the front upper beam 52 pressing down on the flat cable 9 can be increased, and the flat cable 9 can be reliably connected.

Also, when the actuator 3 is rotated to the closed position without a flat cable 9 having been inserted, the front extended portion 523 of the first terminal 5 may be tilted downward. In this case, the leading end of the front extended portion 523 of the first terminal 5, as in the case of the retainer 4, may be positioned above the insertion passage 210 for the flat cable 9. This can keep the leading end of the front upper beam 52 of the first terminal 5 from entering into the insertion passage 210, and keep the leading end of the front upper beam 52 and the leading end of the flat cable 9 inserted into the insertion passage 210 from colliding.

The present disclosure is not limited to the examples shown in FIG. 4 and FIG. 7A. When the actuator 3 is rotated to the open position, the contact portion 522*a* of the first terminal 5 may be positioned above the insertion passage 210. Here, when the actuator 3 is rotated to the closed positon (see FIG. 7B) and the front upper beam 52 is pushed downward, the contact portion 522*a* of the first terminal 5 may move into the insertion passage 210 and come into contact with the conductive surface 92 of the flat cable 9, establishing an electrical connection between the flat cable 9 and the first terminal 5.

In the connector 1 according to the present embodiment, as explained above, the front upper beam 42 of the retainer 4 is elastically deformable and a sound and vibrations can be generated when the engaging portion 422*a* formed in the front upper beam 42 engages the engaged portion of the flat cable 9. This enables the operator to sense when the flat cable 9 has been completely inserted. Also, in the connector 1 according to the present embodiment, the front upper beam 42 of the retainer 4 is elastically deformable, allowing the flat cable 9 to be inserted even when upward movement of the leading end of the front upper beam 42 has been restricted.

Note that the present disclosure is merely an example and that modifications readily devised by a person skilled in the art that remain within the spirit of the present disclosure are included in the scope of the present disclosure. The width, thickness, and shape of components shown in the drawings are represented schematically and are not intended to limit the interpretation of the present disclosure.

The invention claimed is:

1. A connector comprising:

a housing having an opening on a front end and an insertion passage for a flat cable connected to a rear of the opening;

a plurality of terminals accommodated in the housing and configured so as to electrically connect the flat cable; and a retainer accommodated in the housing and having a base portion and a front upper beam extending forward from the base portion and positioned above the insertion passage, the front upper beam including a middle portion positioned in a middle of the front upper beam and having an engaging portion configured so as to engage an engaged portion formed in the flat cable and a forward extending portion extending forward from the middle portion, at least a portion of the engaging portion being positioned in the insertion passage, a region being defined above the leading end of the forward extending portion for restricting upward movement of the leading end of the forward extending portion, and the front upper beam being elastically deformable so that the middle portion moves upward when the upward movement of the leading end of the forward extending portion is restricted by the region.

2. The connector according to claim 1, wherein the retainer has a rear upper beam extending to the rear from the base portion, the connector further comprises an actuator having a cam portion positioned below the rear upper beam of the retainer, and the rear upper beam of the retainer is pushed upward by the cam portion and the front upper beam of the retainer moves downward when the actuator is rotated.

3. The connector according to claim 2, wherein the rear upper beam of the retainer is pushed upward by the cam portion, the front upper beam of the retainer tilts downward, and the leading end of the forward extending portion of the retainer is positioned above the insertion passage of the flat cable when the actuator is rotated without a flat cable having been inserted.

4. The connector according to claim 2, wherein each of the plurality of terminals includes a base portion, a front upper beam having a contact portion extending forward from the base portion and making contact with the surface of the flat cable, and a rear upper beam extending to the rear from the base portion and positioned above the cam portion, the rear upper beam of the terminal being pushed upward by the cam portion and the front upper beam of the terminal tilting downward when the actuator is rotated.

5. The connector according to claim 1, wherein the retainer has a lower beam extending from the base portion, and the lower beam has a connecting portion positioned in front of the front edge of the housing and mounted on a circuit board or has a connector portion positioned to the rear of the rear edge of the housing and mounted on a circuit board.

6. The connector according to claim 1, wherein the forward extended portion has an upper surface extending upward and forward, and the leading end of the upper surface of the forward extending portion is positioned in the region when the middle portion has moved upward.

7. The connector according to claim 1, wherein the region restricting upward movement of the leading end of the forward extending portion is the inner surface of the housing.

8. The connector according to claim 1, wherein the base portion of the retainer has a lance fixed to the inner surface of the housing in the upper end.

* * * * *